US005222662A

United States Patent [19]

Flöter

[11] Patent Number: 5,222,662

[45] Date of Patent: Jun. 29, 1993

[54] PROCEDURE FOR INSTALLATION, STABLE WITH RESPECT TO GAGE DISTANCE, OF AT LEAST THREE TRACKS LYING CLOSELY SPACED TO ONE ANOTHER

[75] Inventor: Friedhelm Flöter, Munich, Fed. Rep. of Germany

[73] Assignee: BWG Butzbacher Weichenbau GmbH, Butzbach, Fed. Rep. of Germany

[21] Appl. No.: 735,823

[22] PCT Filed: Feb. 7, 1991

[86] PCT No.: PCT/DE91/00103

§ 371 Date: Jul. 25, 1991

§ 102(e) Date: Jul. 25, 1991

[87] PCT Pub. No.: WO91/12374

PCT Pub. Date: Aug. 22, 1991

[30] Foreign Application Priority Data

Feb. 14, 1990 [DE] Fed. Rep. of Germany ..... 4004452

[51] Int. Cl.[5] ..... E01B 7/22

[52] U.S. Cl. ..... 238/27; 238/121

[58] Field of Search ..... 238/27, 28, 121; 246/439, 440, 182 AA, 182 AB

[56] References Cited

U.S. PATENT DOCUMENTS

| | | | |
|---|---|---|---|
| 248,840 | 11/1881 | Billings | 238/27 |
| 1,026,106 | 5/1912 | Morgan | 238/27 |
| 4,756,476 | 7/1988 | Fasterding et al. | 238/27 X |

FOREIGN PATENT DOCUMENTS

| | | | |
|---|---|---|---|
| 1273919 | 9/1961 | France | 238/27 |

*Primary Examiner*—Michael S. Huppert
*Assistant Examiner*—James T. Eller, Jr.
*Attorney, Agent, or Firm*—Herbert Dubno

[57] ABSTRACT

The railway crossover includes two main tracks and a third track running between the main tracks and having an axis inclined to respective parallel axes of the main tracks, a plurality of ties each having a relatively long tie and a relatively short tie forming a respective pair of ties and having respective inner ends neighboring one another, inner ends of long ties of subsequent pairs of ties are arrayed alternately on both sides of an axis of the third track at least three subsequent long ties being connected rigidly to one another by connecting joint bars.

3 Claims, 2 Drawing Sheets

PROCEDURE FOR INSTALLATION, STABLE WITH RESPECT TO GAGE DISTANCE, OF AT LEAST THREE TRACKS LYING CLOSELY SPACED TO ONE ANOTHER

CROSS REFERENCE TO RELATED APPLICATION

This application is a national phase of PCT/DE91/00103 filed 7 Feb. 1991 and based in turn upon a German national application P 4004 452.1 of 14 Feb. 1990 under the International Convention.

FIELD OF THE INVENTION

The invention relates to a process for the laying of at least three tracks lying closely spaced to one another.

BACKGROUND OF THE INVENTION

Tracks of the type to be described are laid at small variable distance from one another and utilized primarily at track sections adjacent to switches and crossings in the entrance regions of railroad stations. The distances i.e. distance between tracks minus gage distance; between adjacent rails of the main through-tracks and the connecting and branch tracks vary between a maximal value to the value 0. From a certain minimum distance between rails the provision of separate single ties for each track becomes impossible, since the distance from the margin is insufficient for the proper installation of the means of fastening of the rails. The ties must then be lengthened at least in the region of the adjacent connecting tracks. Since the ties also serve to assure the gage distance, a tie cannot be discontinuous between the two rails of a track without additional means of gage-holding being provided.

Up until now, this gage holding was attained so that every or every other tie extends under three adjacent tracks. The disadvantage of this solution is that very long ties are needed which require much effort in handling and furthermore that during installation of a connecting or branch track, the two main tracks must be taken out of service.

OBJECTS OF THE INVENTION

It is therefore the object of the invention to develop a railroad crossover having the ties installed so that the length of the ties can be limited to less than a maximal length of ties occurring in switches;

SUMMARY OF THE INVENTION

This task is accomplished by the method for the installation and connection of the ties according to the invention. In a single embodiment of the method, it is proposed to utilize track construction material usual in railroad operation as connecting means for the purpose of maintaining of gage distance. The method in accordance with the invention can be applied independently of the material of which the ties are made, such as concrete, steel or wood.

BRIEF DESCRIPTION OF THE DRAWING

The above and other objects, features and advantages will become more readily apparent from the following description, references being made to the accompanying drawing, in which.

SPECIFIC DESCRIPTION

Figure 1:
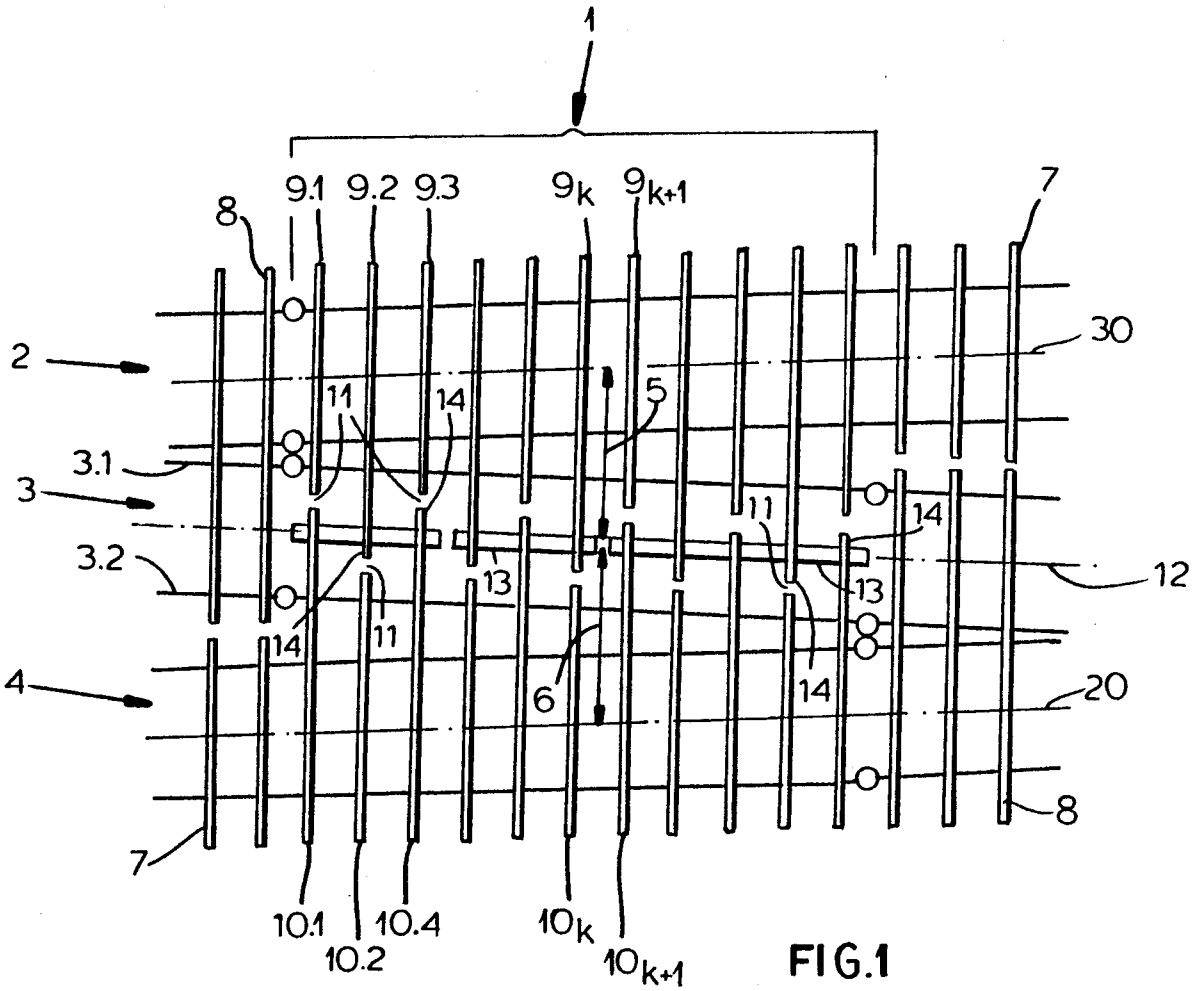
FIG. 1 is a schematically shown top view upon cross ties disposed according to the invention beneath two main tracks and a connecting track running between them.
Figure 2:
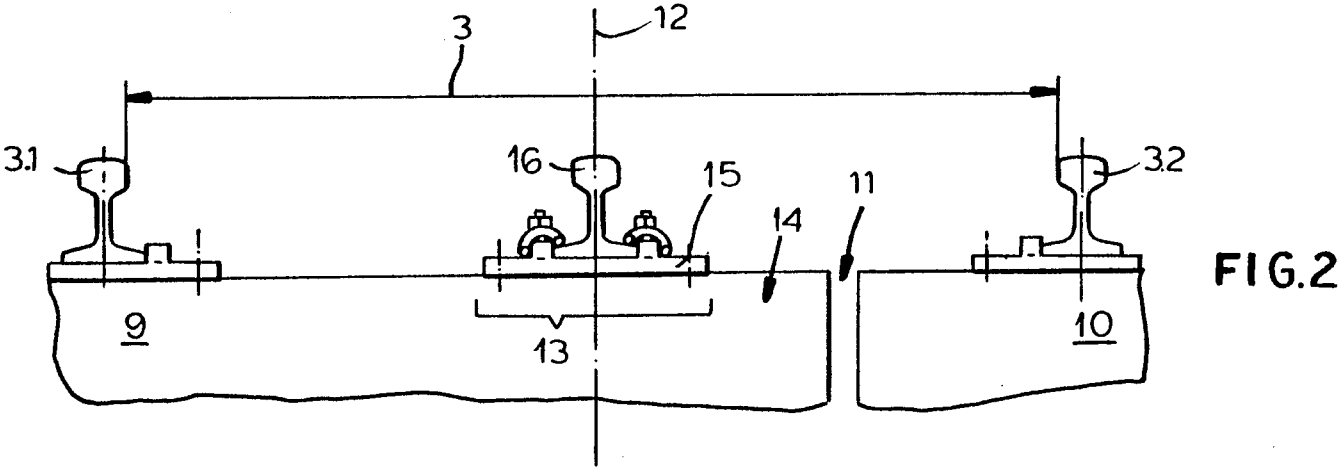
FIG. 2 is a front elevational view of the connecting track, with butt of the ties, and a connecting means for the maintenance of the gage distance.
Figure 3:
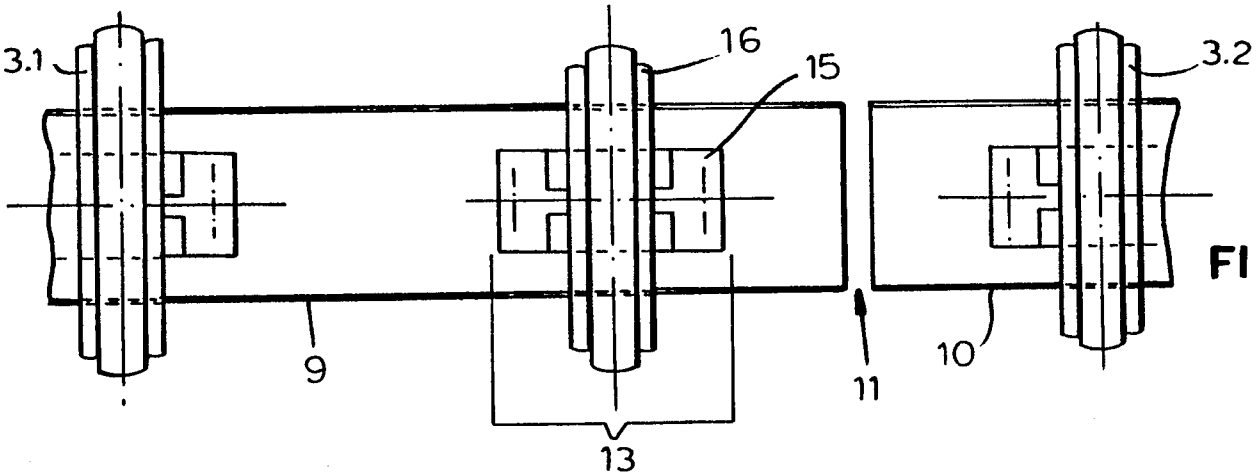
FIG. 3 is a top view of the connecting track, with butt of the ties, and a connecting means for the maintenance of the gage distance.

In a crossover track section 1 the connecting track 3 runs between main tracks 2 and 4 with very small variable distances 5 and 6 corresponding to a distance between an axis 12 and respective axes 20, 30 of the main tracks. Outside the track section 1 normal track ties 7 or ties 8 having a normal length continuous under two tracks can be utilized.

In track section 1, the ties 9, 10 are butted between the rails 3.1, 3.2 of the central connecting track 3, whereby consecutive butts 11 run alternating laterally with respect to axis 12 running between the rails 3.1, 3.2 and being concurrent with the axis of the connecting track. The three tracks 2, 3, 4 are mounted upon pairs of ties 9, 10 of unequal length, whereby a short tie 9.1, 10.2 always follows upon a long tie 10.1, 9.2, and a long tie 9$k$ is coordinated to a short tie 10.$k$ and a short tie 9.$k+1$ to a long tie 10.$k+1$, in pairs.

The stabilization of the gage dimension of track 3, between whose rails 3.1 and 3.2 every tie exhibits a butt 11, is achieved by connecting means 13 arrayed between rails 3.1 and 3.2 of the connecting track 3 in the axis 12. The connecting means 13 connect fixedly at least 3 succesive heads 14 of the underlying longer ties 10.1, 9.2 and 10.3, by means of suitable joint bars.

An example for such known connecting means 13 are stiffeners 16 of rail sections, which by means of track material 15 usual in railway construction, for example, underlay plate, T-headed screw, rail clamp and tie bolt are screwed and connected fixedly with the tops 14 of the ties.

I claim:

1. A railway crossover comprising:

a first longitudinal railway track extending along a first axis and comprising a first outer rail and a first inner rail;

a second longitudinal railway track extending along a second axis parallel to said first axis and comprising a second outer rail and a second inner rail, said first and second inner rails being spaced from one another;

a plurality of regular ties of a normal length extending transversely to said axes and supporting said first and second tracks, said regular ties projecting slightly beyond the respective rails and being provided on axially opposite sides of a crossover path therebetween;

a third longitudinal railway track between said first and second tracks extending along said crossover path and having a respective pair of rails, said third track having a third axis inclined to said first and second axes, a distance between said third axis and said first and second axes continuously varying from one of said sides to the other and becoming less than the normal length of said regular ties;

a plurality of spaced apart and mutually parallel irregular ties extending perpendicular to said first and second axes and supporting said first, second and third tracks along said crossover path, each of said irregular ties including a respective aligned pair of a relatively long tie and a relatively short tie formed with respective inner ends neighboring one another, said inner ends of the long ties alternating along said third axis on opposite sides thereof, so that said inner ends of the long ties are staggered with respect to one another along said tracks, each of said long ties supporting at least three of said rails and having a respective end part projecting beyond a respective rail of said third track; and a plurality of spaced apart longitudinal joint bars aligned along said third axis and rigidly connecting at least three consecutive long ties.

2. The crossover defined in claim 1 wherein said irregular ties have a uniform combined length.

3. The crossover defined in claim 1 wherein said joint bars are stiffeners.

* * * * *